US009738292B2

(12) United States Patent
Moloodi

(10) Patent No.: US 9,738,292 B2
(45) Date of Patent: Aug. 22, 2017

(54) TANK CAR APPARATUS

(71) Applicant: NATIONAL STEEL CAR LIMITED, Hamilton (CA)

(72) Inventor: Sina Moloodi, Mississauga (CA)

(73) Assignee: National Steel Car Limited (CA)

( * ) Notice: Subject to any disclaimer, the term of this patent is extended or adjusted under 35 U.S.C. 154(b) by 87 days.

(21) Appl. No.: 14/799,163

(22) Filed: Jul. 14, 2015

(65) Prior Publication Data

US 2017/0015333 A1 Jan. 19, 2017

(51) Int. Cl.
*B61D 5/00* (2006.01)
*B65D 90/00* (2006.01)

(52) U.S. Cl.
CPC ..... *B61D 5/08* (2013.01)

(58) Field of Classification Search
CPC ..... B61D 5/00; B61D 5/06; B61D 5/08
See application file for complete search history.

(56) References Cited

U.S. PATENT DOCUMENTS 4,184,663 A 1/1980 Rollins et al.
4,220,097 A * 9/1980 Wempe ..... B61D 5/06 105/360
4,394,002 A * 7/1983 Polley ..... B61D 5/08 137/350
4,527,489 A * 7/1985 Schlink ..... B61D 5/08 105/358
4,697,528 A * 10/1987 Rehbein ..... B61D 5/08 105/358
4,892,042 A * 1/1990 Dalrymple ..... B61D 5/00 105/362
5,218,911 A * 6/1993 Rehbein ..... B61D 5/00 105/358
2006/0185554 A1* 8/2006 Dalrymple ..... B61D 5/08 105/358
2007/0125259 A1* 6/2007 Dalrymple ..... B61D 5/08 105/236
2014/0261072 A1* 9/2014 Thompson ..... G05G 1/08 105/358
2015/0135986 A1* 5/2015 Saxton ..... B61D 5/08 105/358
2016/0075347 A1* 3/2016 Thompson ..... F16K 31/46 105/358

* cited by examiner

*Primary Examiner* — Jason C Smith
(74) *Attorney, Agent, or Firm* — Hahn Loeser & Parks LLP

(57) ABSTRACT

A railroad tank car may have external fittings, such as a bottom opening valve, that protrude from the bottom of the tank car tank. In a derailment the tank car tank may meet the ground. A tank skid plate assembly has an accommodation in which to shelter such fittings. The skid plate assembly has a shell with tapered ramps at either end. It mounts to tank reinforcement structure, such as reinforcing bars. Reinforcements may be mounted in the lee of the shell. Those reinforcements may be mounted to the shell only, without welding connection to the tank car tank. The reinforcements may be, or combine with the shell to define either a bridge or a truss that spans the space between the reinforcement bars. The assembly may have an access passageway, such as for admitting a heating pipe. The assembly may include lateral and longitudinal internal webs for providing crush resistance.

34 Claims, 15 Drawing Sheets

TANK CAR APPARATUS

FIELD OF THE INVENTION

This invention relates to the field of railroad tank cars and apparatus therefor.

BACKGROUND

Railroad tank cars have long been known in railroad use in North America. This invention relates to the field of railroad tank cars and apparatus therefor. It pertains to skid and skid assemblies such as may be used to protect extending valves or drains or other fittings such as may protrude from, or stand otherwise outwardly proud of, the main cylindrical tank car tank structure. The reader may find information related to skid assemblies in U.S. Pat. No. 4,184,663 of Rollins et al., issued Jan. 22, 1980; U.S. Pat. No. 4,220,097 of Wempe et al., issued Sep. 2, 1980; U.S. Pat. No. 4,527,489 of Schlink issued Jun. 9, 1985; U.S. Pat. No. 4,697,528 of Rehbein issued Oct. 6, 1987; and U.S. Pat. No. 5,218,911 of Rehbein et al., issued Jun. 15, 1993.

SUMMARY OF THE INVENTION

In an aspect of the invention there is a skid assembly, or skid plate assembly, for a railroad tank car, the tank car having a tank, a protruding member extending proud of the tank car tank, and load spreading apparatus mounted to the tank adjacent the protruding member, the load spreading apparatus extending axially relative to the tank. The skid assembly has an external skid shell. The skid shell having an accommodation for the protruding member. The skid shell has a lengthwise extending footprint that mates to the load spreading apparatus. There is internal reinforcement within the skid shell. The internal reinforcement is mounted to the skid shell. The internal reinforcement discourages deformation of the shell. When the footprint is mated to the load spreading apparatus, the internal reinforcement is mounted independently of the tank.

In a feature of that aspect of the invention, the internal reinforcement defines one of (a) at least a portion of a bridge inside the skid shell, the bridge defining a span that is clear of the tank; and (b) at least a portion of a truss within the skid shell, the truss defining a span that is clear of the tank. In another feature, where the load spreading apparatus of the tank car includes reinforcement bars that extend axially, or longitudinally, along the tank, one end of the span is reacted at a first of the reinforcement bars, an opposite end of the span is reacted at a second of the reinforcement bars distant from the first of the reinforcement bars; and the span is clear of the tank between the first and second reinforcement bars. In another feature, the internal reinforcement includes an axially extending passageway for permitting communication with the protruding fitting from outside the skid shell. In still another feature, the internal reinforcement includes a hollow box. In a further feature, the internal reinforcement has a flange spaced inwardly of the skid shell, and at least a first rib extending between the skid shell and the flange. In a still further feature, the reinforcement includes the bridge, the bridge includes a flange spaced inwardly of the skid shell, and the bridge includes spaced apart ribs connected inside the bridge between the flange and the skid shell. In a further additional feature, the bridge has a span direction and the ribs are oriented cross-wise to the span direction.

In another feature, the skid shell includes first and second spaced apart side plates, and a cover plate extending between the first and second side plates. The side plates have respective margins defining first and second portions of the footprint. In an additional feature, the internal reinforcement has a first portion mounted to the first side plate and a second portion mounted to the cover plate, whereby the internal reinforcement discourages deflection of the cover plate relative to the first side plate. In another feature, the internal reinforcement includes a beam member extending cross-wise between the side plates, the cross-wise extending beam member defining a former of the cover plate between the side plates. In a further feature, the internal reinforcement has a flange mounted to the cross-wise extending beam member, the flange being opposed to the cover plate. In still another feature the internal reinforcement includes a first beam member and a second beam member extending cross-wise between the first side frame and the second side frame, the beam members being spaced apart in the axial direction. In a further additional feature, the internal reinforcement includes a flange member spanning the first and second beam members, the flange being spaced inwardly of, and being opposed to, the cover plate. In yet still another feature, the internal reinforcement has at least a first internal cover reinforcement rib mounted between the cover plate and the flange, the internal rib running transversely to the first and second beams. In still another feature, the reinforcement includes a second member mounted to a free edge of the first member, the second member having a first edge running along the first side plate, and a second member mated to and running along the cover plate. In yet another feature, the reinforcement includes a third member spaced apart from the first member, the second member joining both the first member and the third member. In another feature, the first member, the second member, the third member, the first side plate and the cover plate form a box. In another feature the assembly has opposed first and second reinforcements each defining a box, and an axially extending access passageway is defined therebetween.

In another aspect of the invention there is a skid assembly for a railroad tank car, the tank car having a tank and a member protruding from the tank, the tank having longitudinally extending load spreading apparatus. The assembly has first and second side members, and a cover member. The first and second side members each have a longitudinally running margin for mating with the longitudinally extending load spreading apparatus. The first and second side members define webs standing outwardly away from the tank. The cover member extends between the side members and functioning as a flange relative to the webs. At least a first cross-wise oriented reinforcement extends between the first web and the cover. As installed, the cross-wise reinforcement being free of circumferentially running connection to the tank.

In still another aspect of the invention, there is a railroad tank car tank skid assembly for mounting to axially extending tank car tank reinforcement structure of a tank of the tank car. The skid assembly includes a skid shell and internal bracing mounted within the skid shell. The skid shell has a first margin and a second margin. The first and second margins define axially extending tank mounting interfaces. The skid shell bridges the tank cross-wise to the axial direction. The internal bracing includes at least a first internal former mounted inside the skid shell. The first internal former includes a cross-wise extending web. The first internal former is free of connection to tank reinforcement structure.

In a further aspect there is a tank car skid assembly for mounting to a tank of a tank car. The skid assembly has a skid shell having axially running feet for connection to load spreading apparatus of the tank car, the skid shell having a span between the feet. There is internal reinforcement for resisting deformation of the shell. The internal reinforcement includes at least a first reinforcement having a crosswise web. The web has a first edge and a second edge. The internal reinforcement includes a flange. The first edge is mounted to the skid shell. The flange runs along the second edge and is opposed to the skid shell. The reinforcement is mounted amidst the span between the feet. The reinforcement is mounted clear of the tank structure.

In another aspect, there is a railroad tank car tank skid assembly for mounting to a tank of a tank car. The skid assembly has a skid shell having a tapered ramp and axially running mounting feet; and an internal crush reinforcement mounted in the lee of the ramp. The internal crush reinforcement being mounted independent of the tank car tank structure.

These and other aspects and features of the invention may be understood with reference to the description which follows, and with the aid of the illustrations of a number of examples. The various features identified above may be combined with the aspects in many combinations and permutations.

BRIEF DESCRIPTION OF THE FIGURES

The description is accompanied by a set of illustrative Figures in which.

DETAILED DESCRIPTION

Figure 1A:
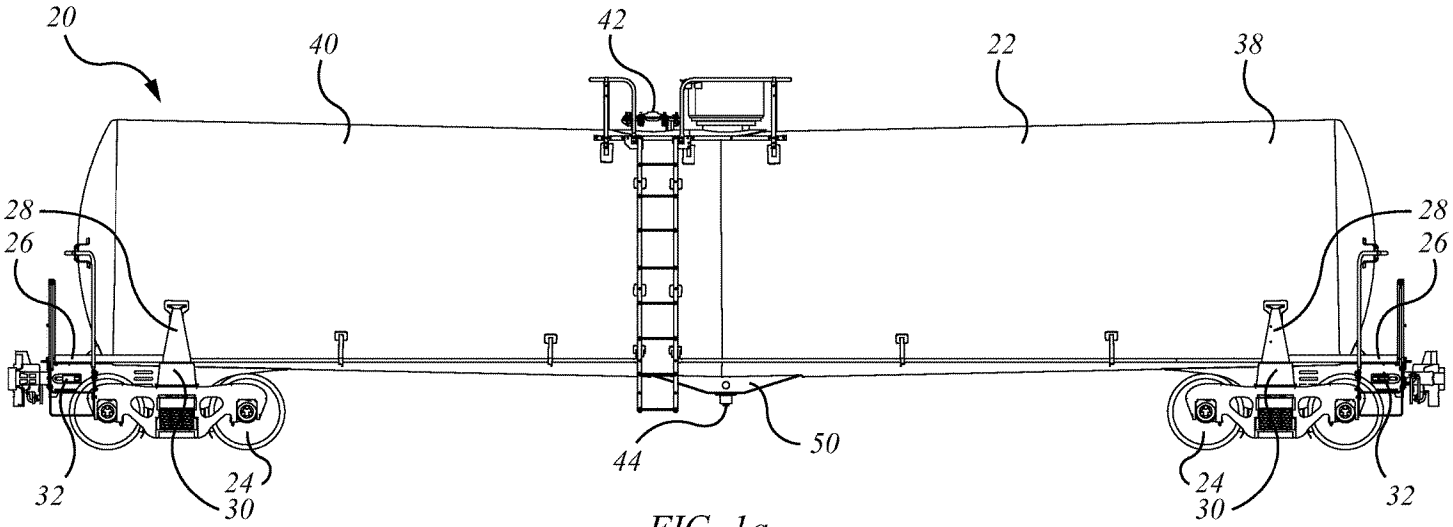
FIG. 1*a* is a general arrangement, side view of a railroad tank car.
Figure 1B:
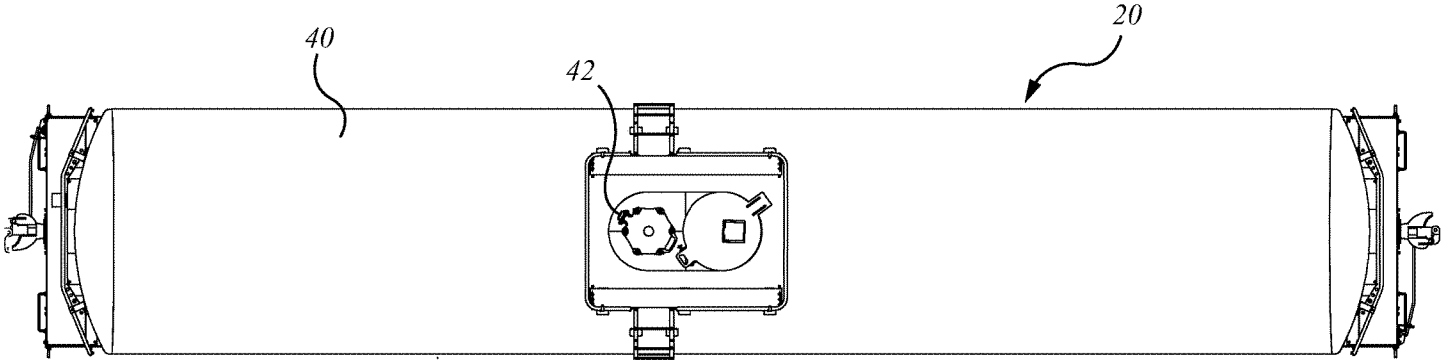
FIG. 1*b* is a top view of the railroad tank car of FIG. 1*a;*
Figure 1D:
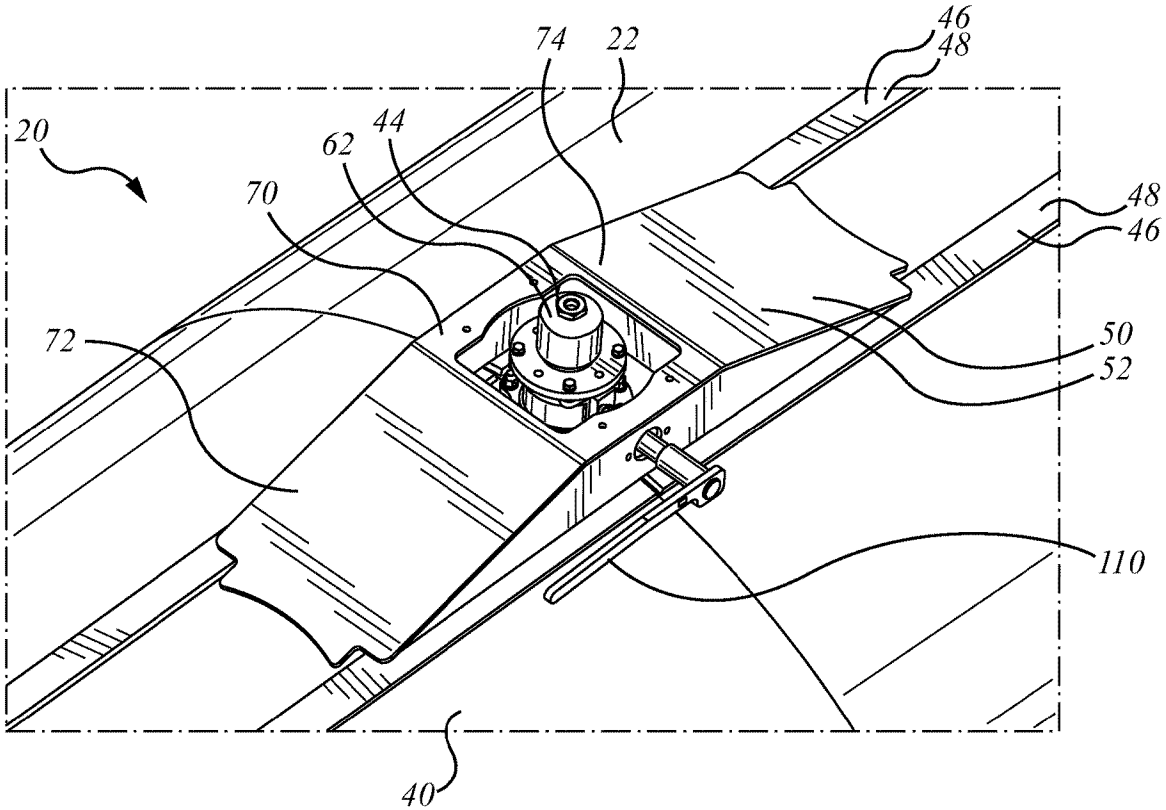
FIG. 1*d* is an isometric view of a skid plate assembly installed on the railroad tank car of FIG. 1*a*, without the tank car tank jacket being shown.
Figure 1C:
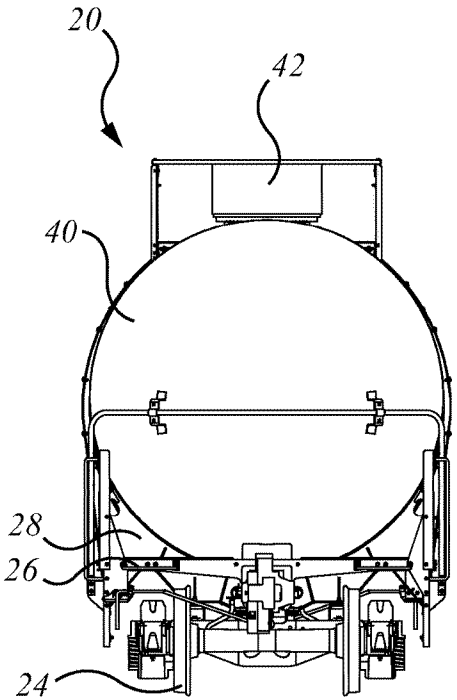
FIG. 1*c* is an end view of the railroad tank car of FIG. 1*a;*

The description that follows, and the embodiments described therein, are provided by way of illustration of an example, or examples, of particular embodiments of the principles, aspects, or features of the present invention (or inventions, as may be). These examples are provided for the purposes of explanation, and not of limitation, of those principles and of the invention. In the specification, like parts are marked throughout the descriptive text and the drawings with the same respective reference numerals. The drawings are generally to scale, and may be taken as being to scale unless otherwise noted. Unless noted otherwise, the structural members of the car may be taken as being fabricated from steel.

The terminology used in this specification is thought to be consistent with the customary and ordinary meanings of those terms as they would be understood by a person of ordinary skill in the railroad industry in North America. Following from decision of the CAFC in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years experience in the railroad industry in North America or in other territories or former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad tank car, the longitudinal direction is parallel to the tank car tank cylinder. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad tank car, or car unit, or of the centerline of a centerplate at a truck center. The term "longitudinally inboard", or "longitudinally outboard" is a distance taken relative to a mid-span lateral section of the tank car.

The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than". The directions correspond generally to a Cartesian frame of reference in which the x-direction is longitudinal or lengthwise, the y-direction is lateral or cross-wise, and the z-direction is vertical. Inasmuch as this specification relates to a tank car, there may be a co-ordinate system based on the tank, namely an axial direction that is the same as the longitudinal rolling direction, a radial direction extending away from the axial direction vector along the tank car tank centerline, and a circumferential or peripheral direction.

Given that the railroad tank car described herein may tend to have both longitudinal and transverse axes of symmetry, a description of one half of the car may generally also be intended to describe the other half as well, allowing for differences between right hand and left hand parts. The abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

FIG. 1 shows a side elevation view of an example of a railroad tank car 20 that is intended to be representative of a wide range of tank cars in which the present invention may be incorporated. Car 20 may be suitable for a variety of uses. By way of a general overview, a tank car 20 may have a tank car tank shell, or car body 22 that is carried on trucks 24 for rolling operation along railroad tracks. Car body 22 may have first and second end sections 26 that may include a cradle 28, a cross-wise extending main bolster 30 upon which cradle 28 is supported, and a lengthwise running stub sill that includes a draft sill 32, main bolster 30 being mounted cross-wise to the stub sill. End sections 26 seat on trucks 24.

A lading containment vessel in the nature of a tank car tank 40 may seat on cradles 28. Tank car tank 40 may have a generally cylindrical shell 38 of formed and welded steel plates. Tank car tank 40 may also have various valves and fittings, such as a top valve assembly, indicated generally as 42. Tank car tank 40 may also have other protruding fittings such as a bottom outlet valve (BOV) 44 that stands outwardly proud of steel shell 38. Tank car tank 40 may have a reinforcement, or reinforcements, 46. Reinforcements 46 may have the form of doublers, or pads, or strips, or bars 48 that run in the longitudinal or lengthwise, or axial direction along the belly of tank car tank 40. Bars 48 may be spaced apart in the circumferential direction, and may be located symmetrically to either side of the vertical centerline plane of tank car tank 40.

A skid plate assembly may be shown generally as item 50. Skid plate assembly 50 may be symmetrical in the fore-and-aft direction (i.e., the axial direction of tank car tank 40), and in the circumferential direction. Skid plate assembly 50 may include an external shell 52. Shell 52 may include a cover plate or plates 54 and left and right hand side plates 56, 58. Skid plate assembly 50 may include a relief, or recess, or alcove, or opening, or chamber, or allowance, or accommodation 60 that, on installation, locates about, or provides an access opening to or for, a tank car feature or mechanism, or fitting, 62 that stands outwardly proud of the plates of tank car tank shell 38. Fitting 62 may be bottom outlet valve 44.

Side plates 56, 58 may have first and second end portions 64, 66, and a middle portion 68 between the ends. The end portions 64, 66 may be tapered on an angle corresponding to angle $[alpha]_{72}$ of the wedge or ramp of the skid. Middle portion 68 may be of constant height and extends between end portions 64, 66. One, the other, or both of side plates 56, 58 has an access opening 108 through which to insert a crank shaft for crank handle 110 that operates BOV 44.

Cover plate 54 may include a central portion 70, and first and second end or ramp portions 72, 74. Ramp portion 72 may be mounted to end portions 64, and ramp portion 74 may be mounted to end portions 66, such that each end of shell 52 has a wedge-shaped form. Similarly central portion 70 may have lateral margins that are mounted to the outstanding margins of middle portions 68 of side plates 56, 58. Accommodation 60 may be formed in central portion 70. Where central portion 70 is a substantially planar plate, accommodation 60 may have the form of a cut-out made in that plate. Central portion 70 may also have fittings 76, such as pre-located bores, for receiving mechanical fastening hardware. The most distant toes of ramp portions 72, 74 may have accommodations or allowances, or cut-outs, as at 78, that conform to the shape of bars 48.

The width of cover plate 54 may be slightly wider than the span between the outward margins of side plate 56, 58, such that the lateral margins of cover plate 54 extend beyond the side plates to permit fillet welding both laterally inside and laterally outside at the mating edges.

Skid plate assembly 50 may have an internal reinforcement or internal reinforcements, 80. Reinforcements 80 may be termed fittings, or forms, or formers, or frames, or brackets, or braces, or bracing, or terms of such nature. They may also be termed crush resistors, and, as the term may imply, their purpose or function may be to discourage collapse of skid plate assembly 50 should circumstances occur in which car 20 finds itself resting upon skid plate assembly 50. Alternatively, they may be called forms, or formers, or frames that function to encourage shell 52 to maintain its shape when subject to loading. Reinforcements 80 may be said to be hidden by, or sheltered by, or to be mounted in the lee of, shell 52, in the sense of being inside the shell, and tending not generally to be visible externally.

In the case of skid plate assembly 50, each crush resistor may have a first portion or member 82 that resists angular deflection of one or both of side plates 56, 58 about the x-axis relative to cover plate end portion 72 or 74, as may be. That is, first member 82 may be a web or gusset or beam, or other member extending predominantly laterally. It may extend in a radial-circumferential plane, generally cross-wise to tank car tank 40.

Reinforcement 80 of skid plate assembly 50 may also have a second portion or member, 84, that may be positioned out-of-plane relative both to the adjacent side-plate and to first member 82. For example, member 84 may be a plate, or web, or gussets, or flange that has a first edge or margin mated to a corresponding edge or margin of first member 82, and a second edge or margin mated to the respective side plate 56, 58, distant from tank car tank 40.

Reinforcement 80 may also include a third portion or member 86, such as may be termed a web, or a gusset, or a beam. That member may, like first member 82, have a first edge that mates with a respective side plate 56 or 58, and a second edge that mates with cover plate 54, such as to define a shear web or gusset tending to discourage sideways deflection of side plate 56 or 58, as may be. Third portion or member 86 may be located longitudinally more distant from the center of skid plate assembly 50 than is first member 82. Member 86 may lie in a radial circumferential plane. Members 82 and 86 may lie in parallel planes. Members 82 and 86 may extend perpendicular to side plate 56 or 58, as may be. Members 82 and 86 may also be considered to be beams that extend cross-wise within shell 52 and act to bridge the unsupported span between the end reactions at side plates 56 and 58.

In the example of skid plate assembly 50, members 82, 84, and 86 may co-operate to define a cross-wise extending channel section 90 that may be a U-pressing. One leg of channel section 90 (corresponding to member 86) may be shorter than the other leg (corresponding to member 82), the difference in leg height corresponding to the angle of taper of the ramp portion (be it 72 or 74). The toes of the legs may be fixed to the inside face of shell 52, and in particular of ramp portion 72 (or 74, as may be) as by welding.

Reinforcement 80 may also include internal, longitudinally oriented (i.e., axially relative to tank car tank 40) members 88, such as may be webs or gussets, or ribs that mate with, and back, ramp portion 72 (or 74), extending between and being joined to reinforcement members 82 and 86. Members 88 may stand perpendicularly away from ramp portion 72 or 74, as may be. Members 88 may define shear webs that are joined at top and bottom to flanges, namely (a) the bottom flange defined by ramp portion 72 (or 74); and (b) a top flange defined by member 84, and at both ends to the cross-wise extending webs, i.e., members 88 define shear webs having flanges on all four edges or margins.

Member 84 may have an opening or relief, or lightening hole formed therein, as indicated centrally at 106. The cross-wise running margins 92, 94 of second member 84 may function as flanges of the vertical webs defined by first member 82 and third member 86, respectively. The end margins of member 84 may be welded to side plates 56 and 58 distant from cover plate 54. Member 84 may be said to be positioned in spaced apart relationship to portion 72 (or 74 as may be), and may be in opposed relationship.

End portions 72, 74 may have central reliefs or rebates 100 such as to leave two extending portions or regions, or toes, or wings 96, 98 that run along, and are secured to the diminishing pointed ends of side plates 56, 58.

In this arrangement, skid plate assembly 50 may have a footprint on bars 48. The footprint may include first and second portions, or feet, corresponding to the lengthwise or axially extending margins 102, 104 of side plates 56, 58 that are most distant from cover plate 54. Skid plate assembly 50 may be secured to bars 48 along that footprint along those two feet, e.g., by welding. The other portions of skid plate assembly 50 may remain free of welded connection to bars 48 or tank car tank 40 more generally, i.e., such that assembly 50 has an unsupported span between spaced-apart bars 48. Expressed differently, skid plate assembly 50 may be secured only to bars 48, (or such other reinforcing doubler or skin as tank car tank 40 may have) as opposed to being welded to the shell plates 38 of tank car tank 40 itself. In this arrangement, internal reinforcements 80 may be mounted to shell 52 without being directly mounted to, or connected to, or welded to, tank car tank 40 itself. To the extent there is a heat affected zone, it is in members 48 and associated with the longitudinal fillets of the footprint. Such an arrangement may tend to avoid creating circumferentially oriented heat affected zone irregularities or defects in the shell plates of tank car tank 40 themselves. Reinforcement 80, and cross-wise extending member 84 may be said to be supported, or suspended, or mounted clear of tank car tank 40, or to be independent of tank car tank 40. In some embodiments, it is possible that member 80 (or 84) may touch or abut the outside surface of tank car tank 40 without connection thereto, and, in particular, may be free of a welded connection or other property-changing connection such as might otherwise result in a heat affected zone or other feature altering, degrading, or impairing, the local physical properties of the tank plates. Expressed differently, the footprint may include lengthwise connections, such as weldments, while being free of circumferentially extending welded connections.

Reinforcement 80 may tend to define at cross-wise beam, be it member 82 or 86, both of those elements being stabilised by member 84 against out-of-plane deflection. The beam, or beams, so defined and the internal webs or ribs defined by members 88 may tend to resist deformation of said assembly in a first degree of freedom, namely crushing in the radial direction. The shear web or gusset defined by member 82 or 86 may also tend to resist lateral deformation of skid plate assembly 50 in a second degree of freedom, in effect rotation about the longitudinal or x-axis. Member 84 working on combination with members 56, 58 and 82 and 86 may tend to resist deformation tending to deflect assembly 50 in a parallelogram manner, that being a third degree of freedom, in effect, rotation about the r-axis.

Figure 3A:
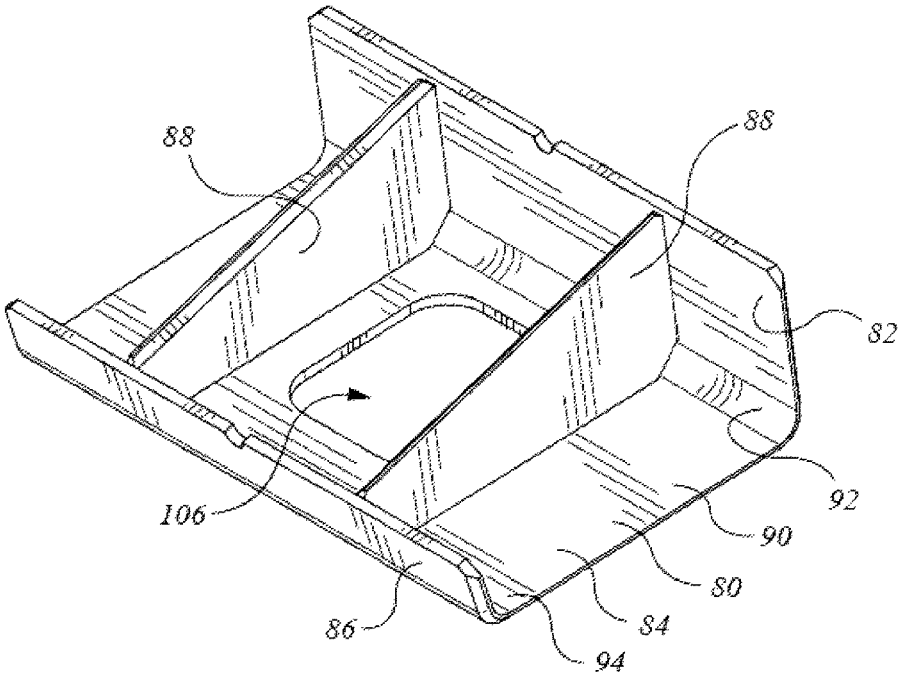
FIG. 3*a* is an isometric view of a crush reinforcement of the skid plate assembly of FIG. 2*a;*
Figure 3B:
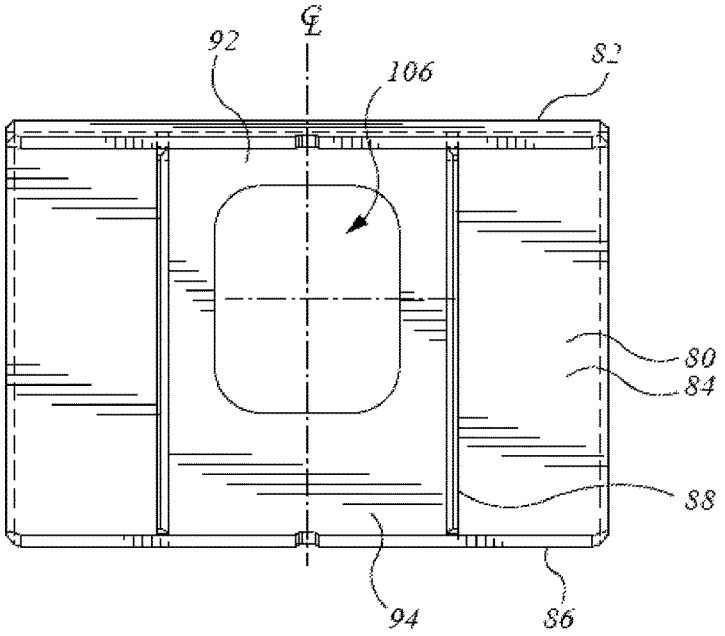
FIG. 3*b* is a top view of the crush reinforcement of FIG. 3*a;*
Figure 3C:
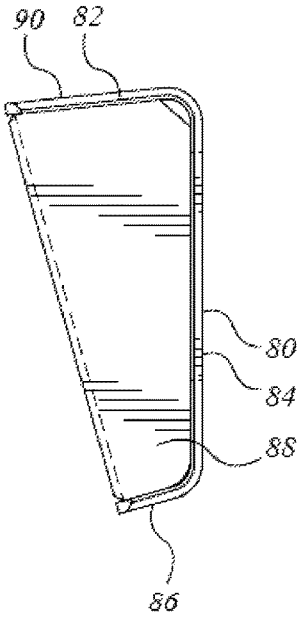
FIG. 3*c* is a side view of the crush reinforcement of FIG. 3*a;*
Figure 3D:
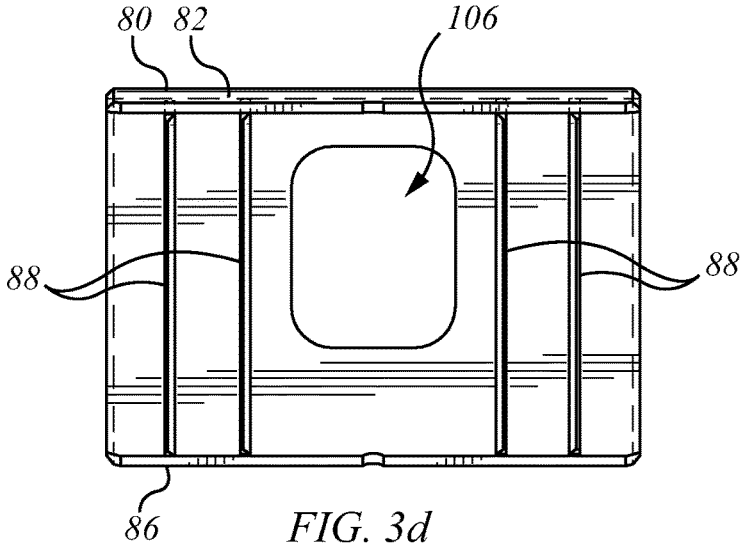
FIG. 3*d* shows an alternate embodiment to that of FIG. 3*b;*
Figure 3E:
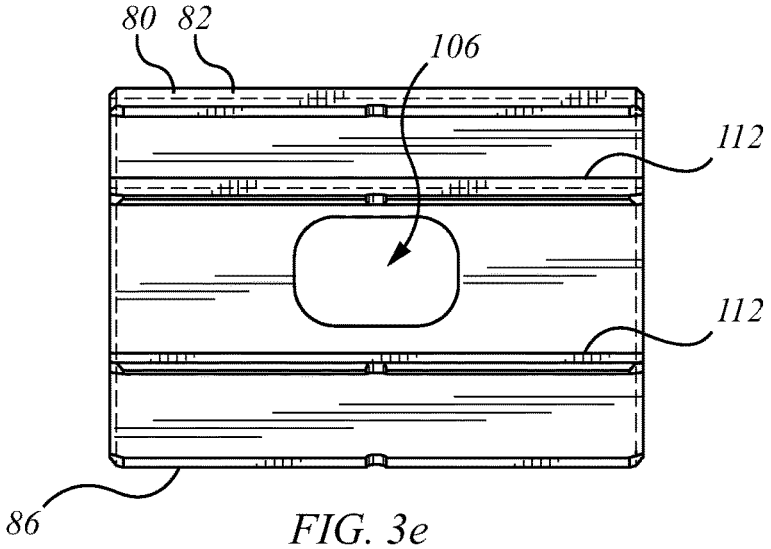
FIG. 3*e* shows another alternate embodiment to that of FIG. 3*b;*
Figure 3F:
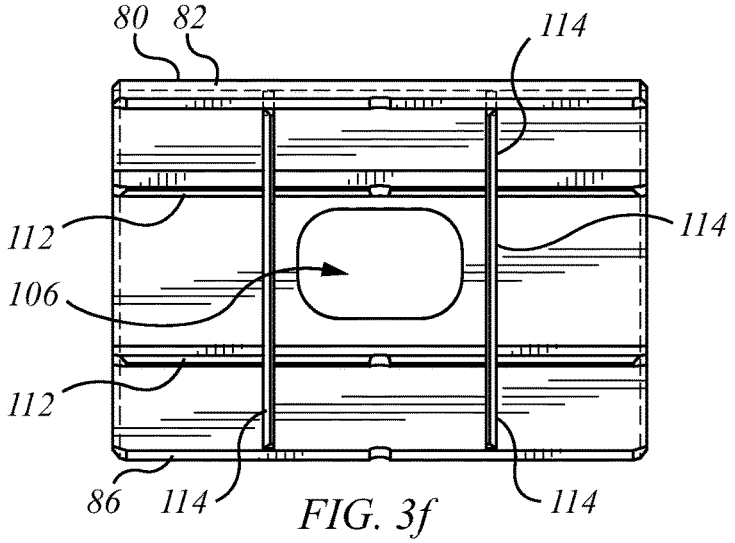
FIG. 3*f* shows a further alternate embodiment to that of FIG. 3*b;*
Figure 3G:
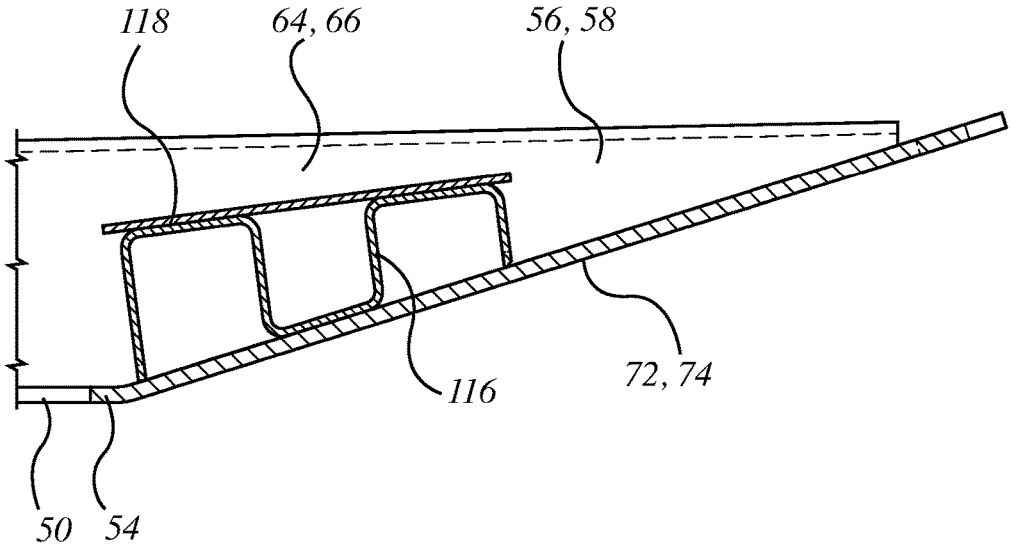
FIG. 3*g* shows a cross-sectional view of an alternate embodiment to that of FIG. 2*d*, one half being shown.
Figure 3H:
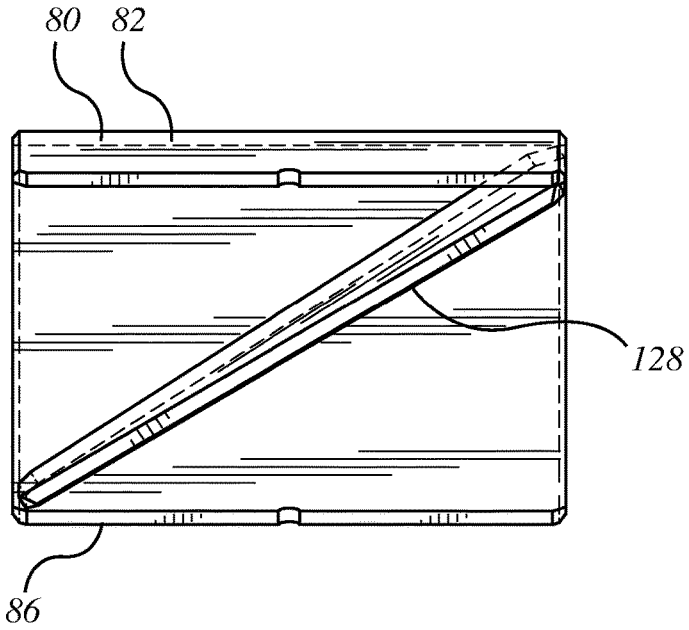
FIG. 3*h* shows a yet further alternate embodiment to that of FIG. 3*b;*

Alternate embodiments are also possible. In the alternate arrangement of internal reinforcement 80 of FIG. 3*d*, additional web members 88 are provided, there being pairs of two stiffeners 88 to each side of hole 106, all other elements being as before. In the alternate arrangement of reinforcement 80 of FIG. 3*e*, the main internal webs or stiffeners or gussets 112 are oriented cross-wise, rather than longitudinally, with opening 106 being adjusted accordingly. In the alternate arrangement of FIG. 3*f*, reinforcement 80 may have lateral reinforcements 112, and perpendicular internal gussets 114. In the alternate embodiment of FIG. 3*g*, reinforcement 126 may have a laterally running internal corrugation member 116 such as may define a series of lateral web, and a cap or flange member 118 such that the combination of the shell outer skid plate 72, corrugation member 76, and a closing member, or plate, or flange member 118 form a deep-section beam or bridge that may tend to be resistant to crushing. Flange member 118 need not be parallel to the plane of member 72 or 74, but it may be, or it may be roughly parallel to the tank surface, as shown. In the embodiment of FIG. 3*h*, the internal reinforcement or gusset, or web, or stiffener 128 may be mounted in an orientation that is not perpendicular to the end walls i.e., members 82 and 86, but rather angled to them. In the embodiment shown, a single internal web 128 is mounted on the diagonal as viewed. More than one such diagonal member could be employed. In the embodiment of FIG. 3*h*, opening 106 may be omitted.

In the alternate embodiment of FIGS. 4*a* to 4*e*, it may be that tank car 120 has a fitting 122, such as may be in the form of pipe or conduit that runs along the car, and that is in some way connected to, or is auxiliary to, the BOV or such other fittings as may be. For example, fitting 122 may be a heating pipe 124, such as may be helpful where the lading of car 120 may tend to flow more easily when warmed somewhat.

Figure 4A:
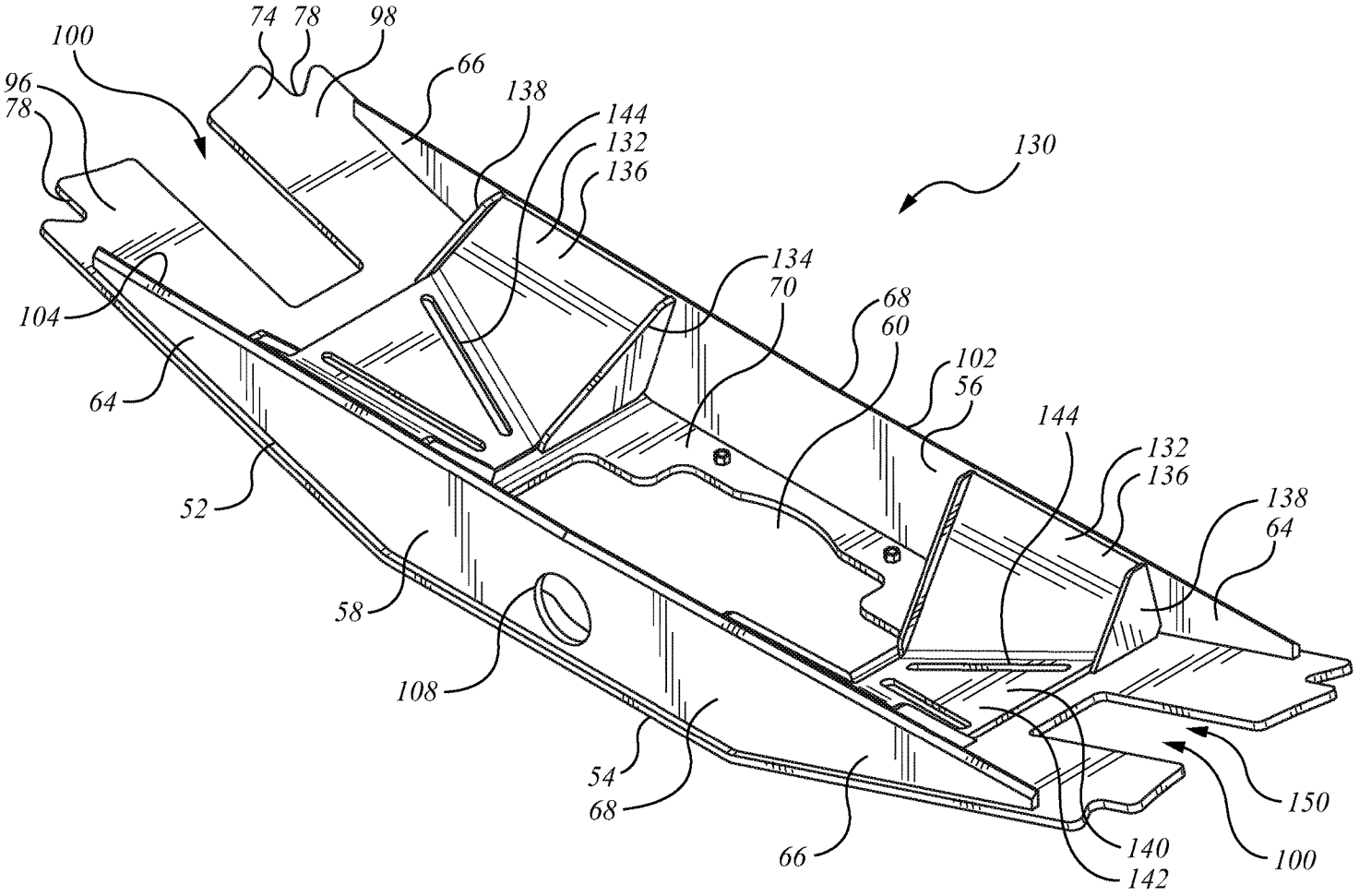
FIG. 4*a* is an isometric view of an alternate embodiment of skid plate assembly to that of FIG. 2*a;*
Figure 4B:
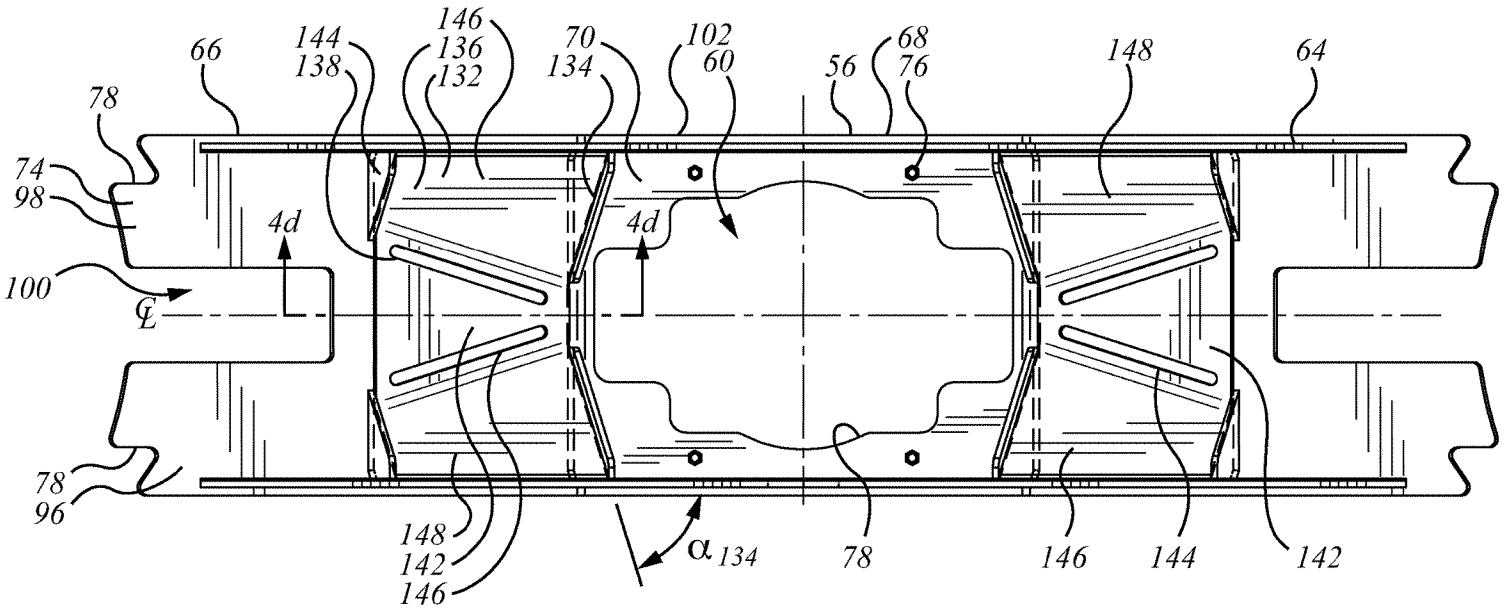
FIG. 4*b* is a top view of the skid plate assembly of FIG. 4*a;*
Figure 4C:
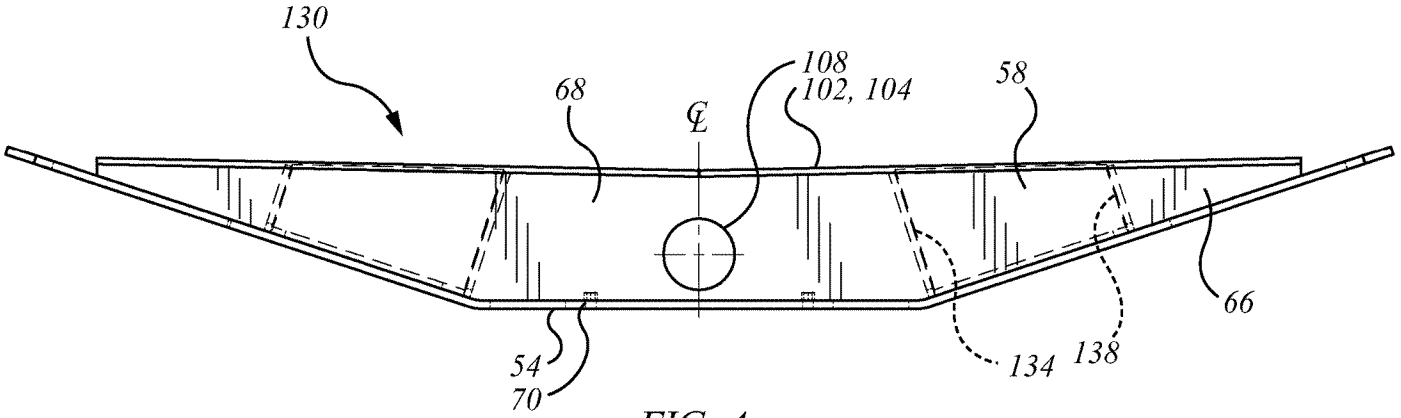
FIG. 4*c* is a side view of the skid plate assembly of FIG. 4*a;*
Figure 4D:
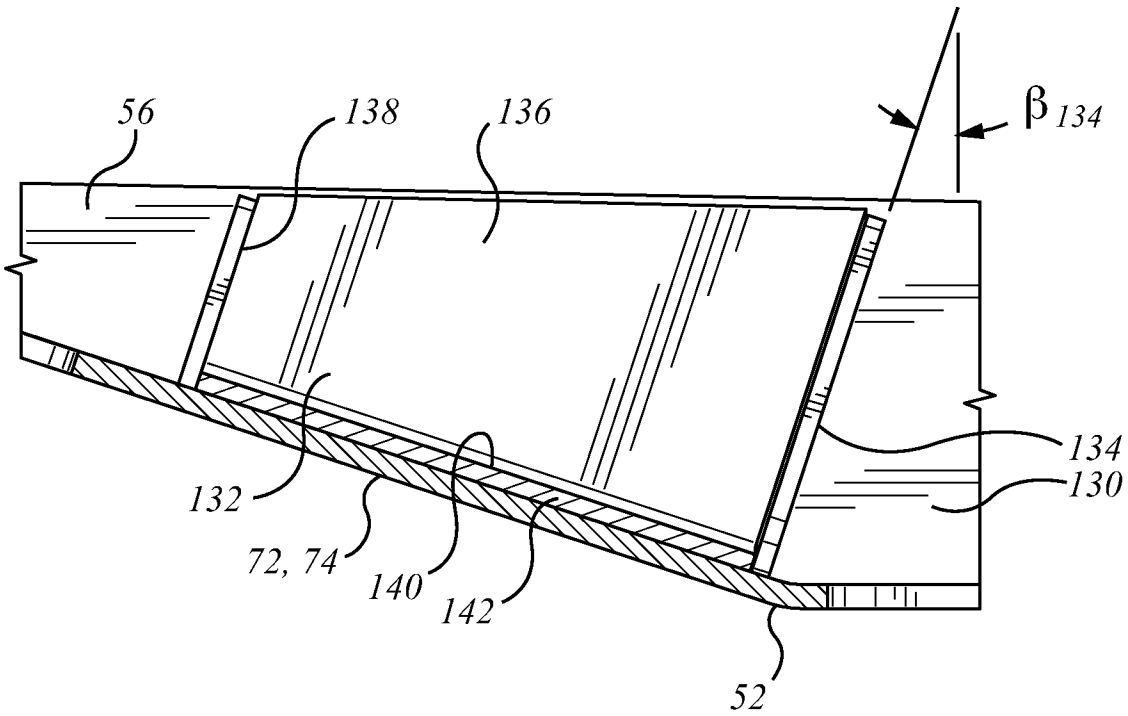
FIG. 4*d* is an enlarged sectional detail of the skid plate assembly of FIG. 4*b* taken on section '4*d*-4*d*'.
Figure 4E:
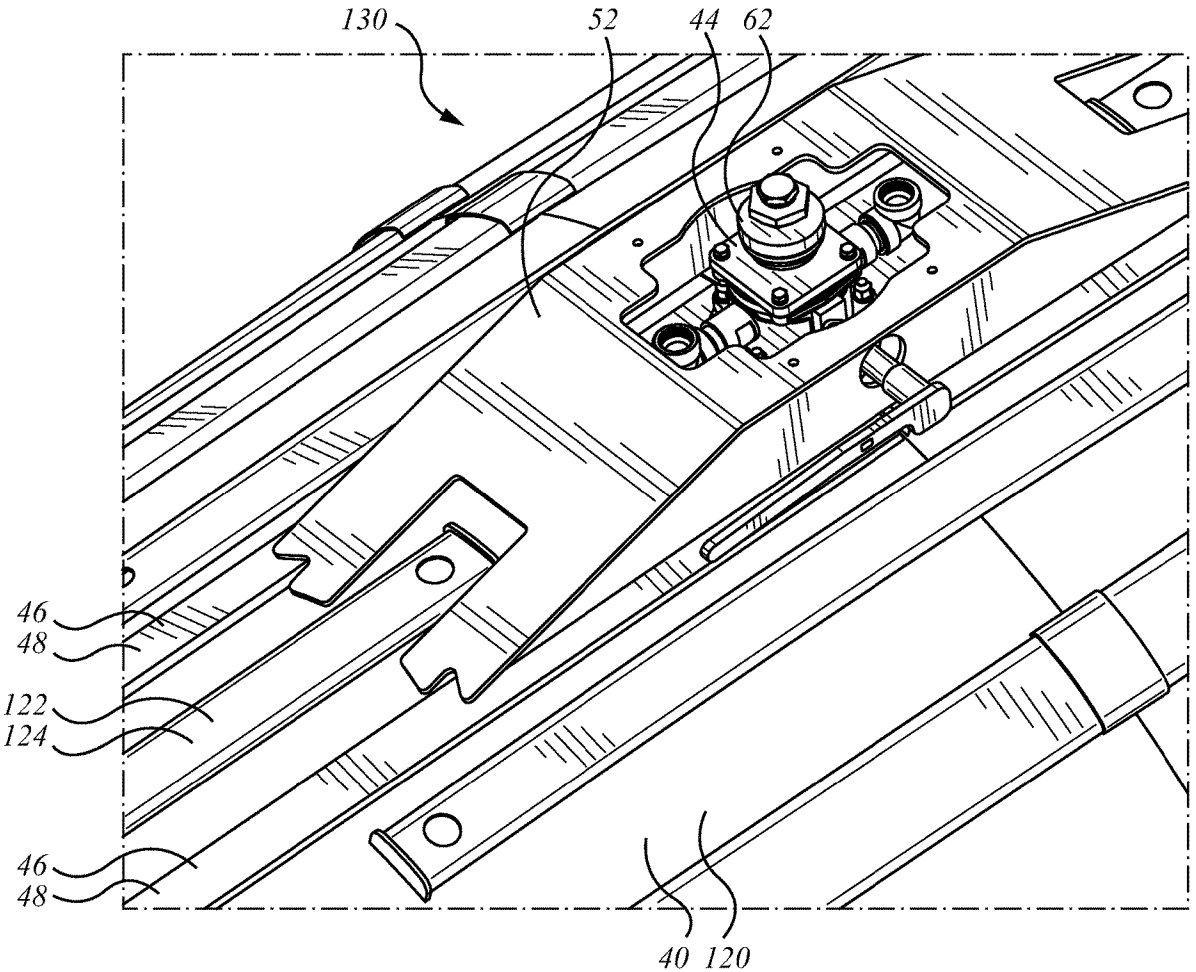
FIG. 4*e* is a general arrangement of an installation of the skid plate assembly of FIG. 4*a* as installed, without the tank car tank jacket being shown.

In this instance, skid plate assembly 130 may include cover plate 54 and side plates 56, 58 as before. However, in place of the channel sections of reinforcements 80, skid plate assembly 130 may have crush resistors or reinforcements 132. Reinforcements 132 may have a first member 134 that may have the form of a plate or gusset that extends generally cross-wise to, and has one margin welded to, side plate 56 or 58 as may be. Another margin may be welded to cover plate 54. Member 134 may be generally triangular, and may extend substantially perpendicular to the respective side plate. Alternatively, as shown in FIG. 4*b*, first member 134 may be angled or tilted relative to the longitudinal and circumferential axes at some non-square angle, as indicated by angle $[alpha]_{134}$. First member 134 may also be angled relative to the vertical axis, as seen in FIGS. 4*c* and 4*d*, and, as indicated in FIG. 4*c*, may be perpendicular to the skid surfaces of the ramp portions 72 (or 74). The angle of tilt relative to the vertical in this view may correspond to the slope angle of the ramp $[alpha]_{72}$.

Skid plate assembly 130 may also have a second reinforcement 136 which may have a first margin mated to the respective side plate near to the proximate edge thereof close to the footprint margin 102 (or 104), as opposed to the distal edge that stands away from tank car tank 40; and a second margin welded to a third edge of first reinforcement 134.

Skid plate assembly 130 may have a third reinforcement 138, which may also be a web or gusset having a first margin joined to the respective side plate; a second margin joined to cover plate 54; and a third margin joined to second reinforcement 136. Third reinforcement 138 is oriented cross-wise to the respective side plate, and may be predominantly or substantially perpendicular to side plate 56 (or 58). Third reinforcement 138 may stand substantially parallel to first reinforcement 134. Reinforcements 134, 136, and 138, cover plate 54 and side plate 56 (or 58) may be joined together to form a closed box, or boxes. The box, or boxes, may have a generally triangular form. It may tend to taper from a larger base near the center of skid plate assembly 130 to a smaller triangular section more distant from the center. Reinforcement 132 may then have a shape like a wedge, tapering both in width and in depth to give the shape of a tapered prism. Each of first reinforcement 134, second reinforcement 136 and third reinforcement 138 may be planar or substantially planar.

Two units of second reinforcement 136 may be end regions or portions of a single formed web or sheet 140 that also has a medial portion 142. Sheet 140 may have apertures 144, 146 that permit sheet 140 to be welded to the inside face of cover plate 54. Apertures 144 may have the form of slots. The slots may be angled relative to the longitudinal centerline, as indicated by angle $[alpha]_{144}$. Other embodiments may not have apertures 144.

The use of the closed box reinforcements rather than the cross-wise extending panels may leave a space, or chamber, or allowance or void, or passageway, indicated generally as 150, between left hand, 146, and right hand 148, crush resistors 132, as indicated. Passageway 150 provides an allowance through which to run a fitting such as heating pipe 124. The passageway also runs between the toes of the ramp portions, as at rebate 100.

Figure 4F:
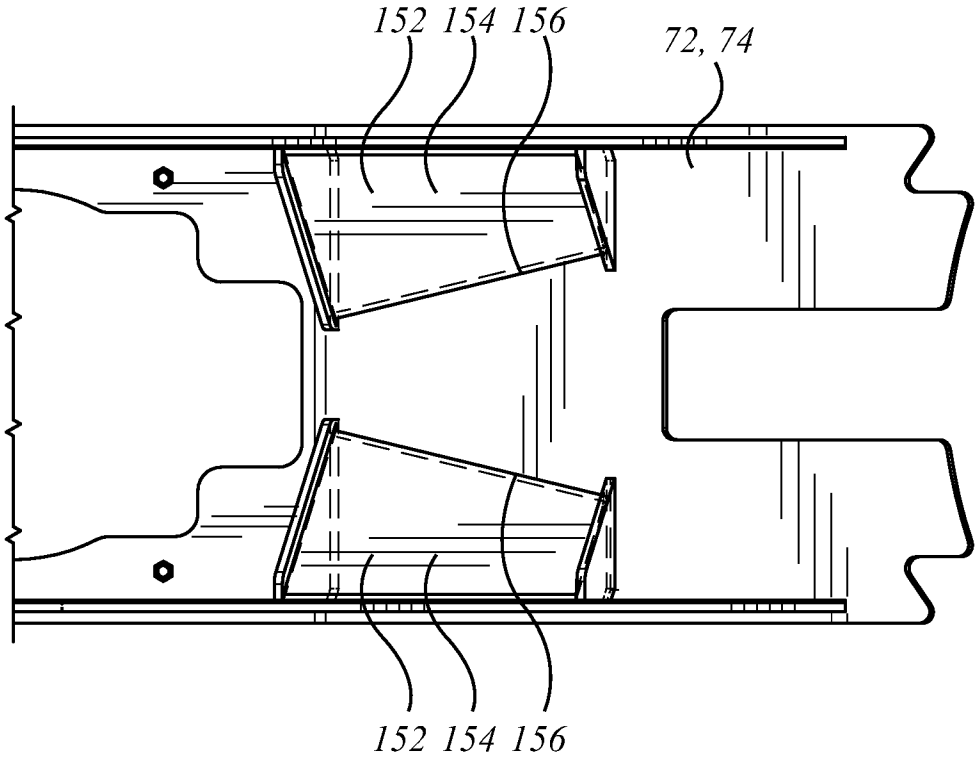
FIG. 4*f* is a partial top view of an alternate assembly to that of FIG. 4*b;*

In the alternate embodiment of FIG. 4*f*, the skid plate assembly is the same as skid plate assembly 130, but rather than having a single continuous web or sheet 140, reinforcements 152 are single elements with the closing hypoteneuse member 154 being welded to the cover plate as at 156.

As before, the crush resisting member may tend to discourage vertical crushing in the radial direction, lateral collapse of the side plates in rotation about the x-axis; and relative deflection of the side plates in torsion relative to the r-axis.

Figure 2A:
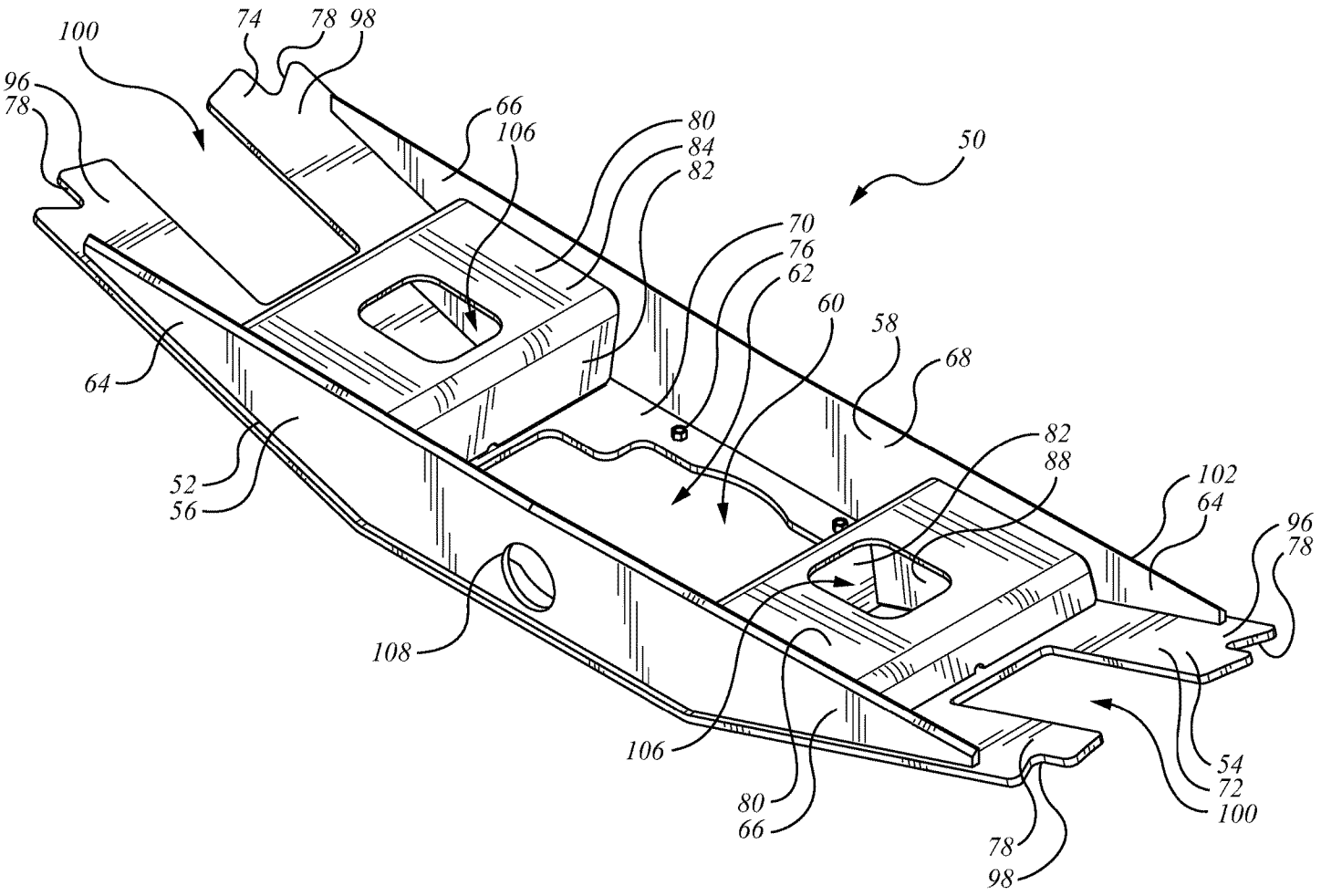
FIG. 2*a* is an isometric view of the skid plate assembly of FIG. 1*d* for the railroad tank car tank of FIG. 1*a;*
Figure 2B:
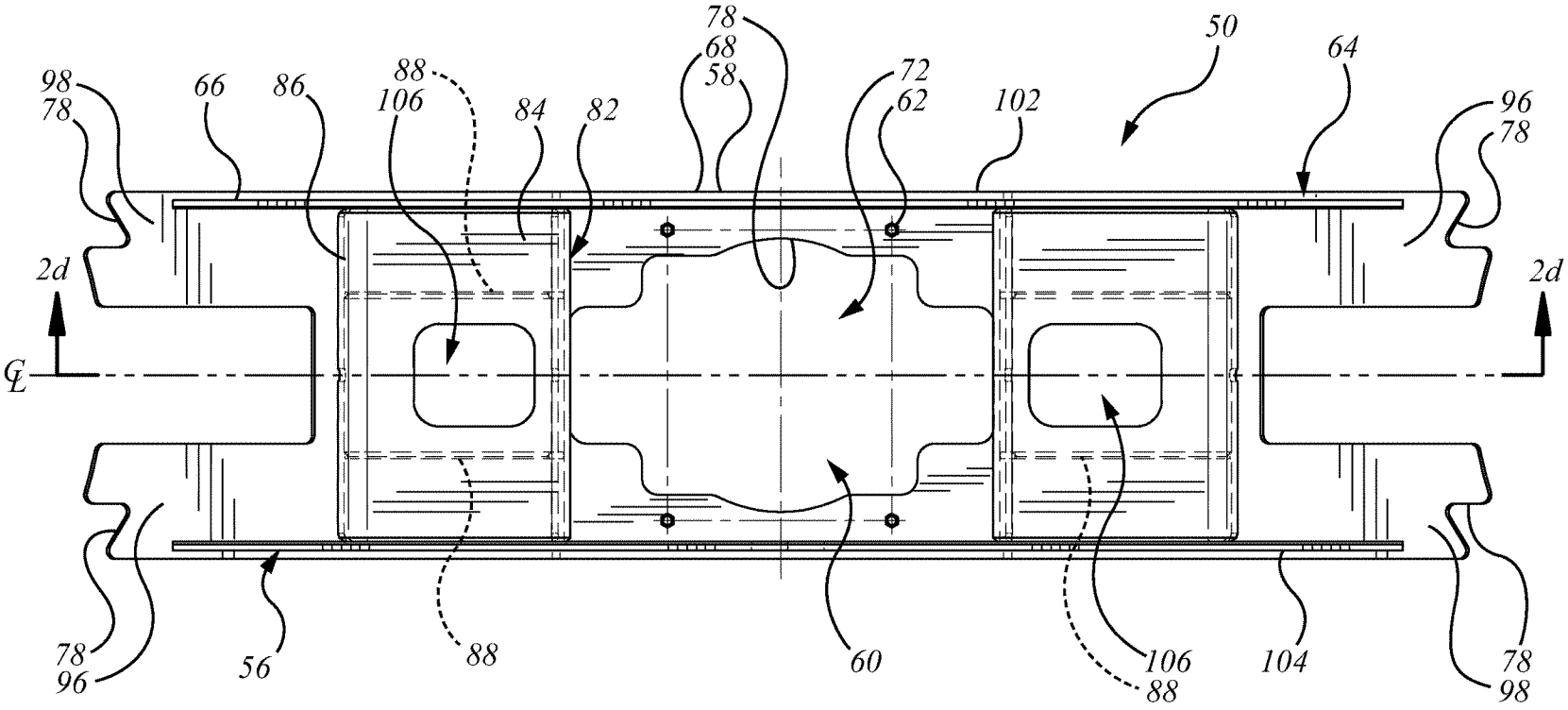
FIG. 2*b* is a top view of the skid plate assembly of FIG. 2*a;*
Figure 2C:
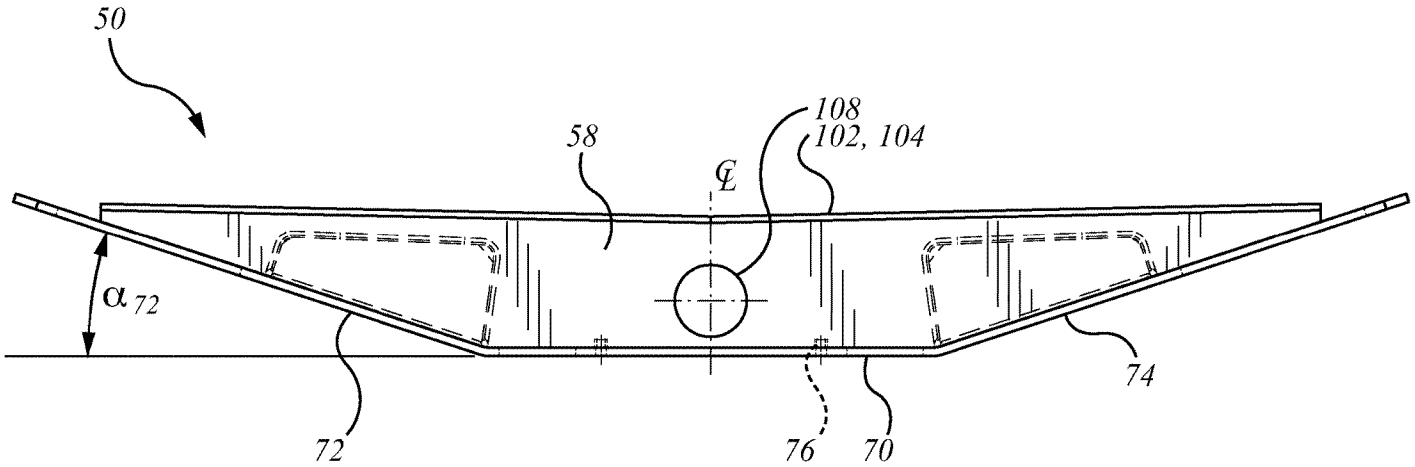
FIG. 2*c* is a side view of the skid plate assembly of FIG. 2*a;*
Figure 2D:
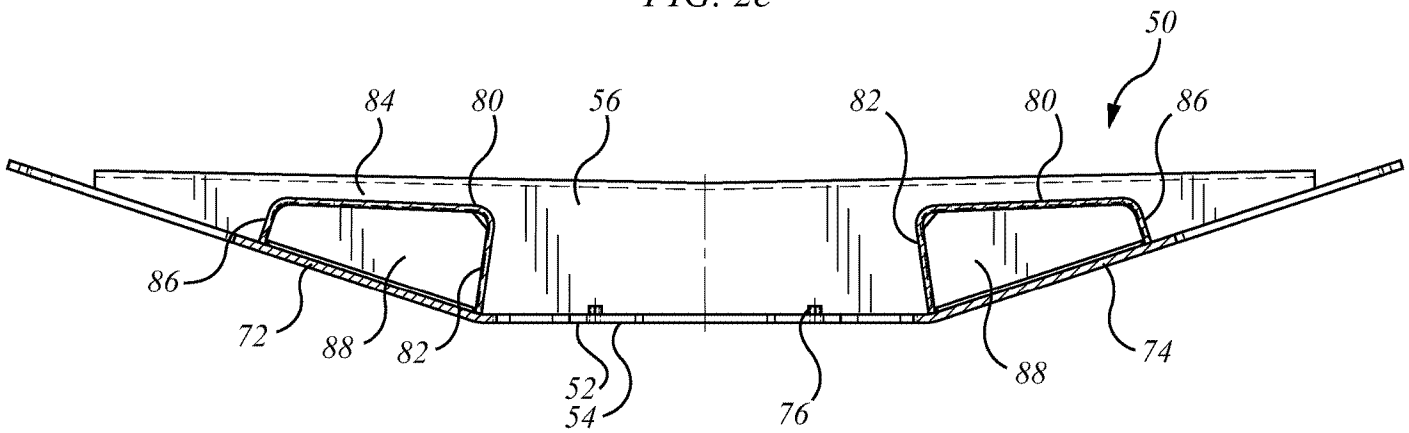
FIG. 2*d* is a cross-sectional view of the skid plate assembly of FIG. 2*a* taken on section '2*d*-2*d*' of FIG. 2*b;*
Figure 5:
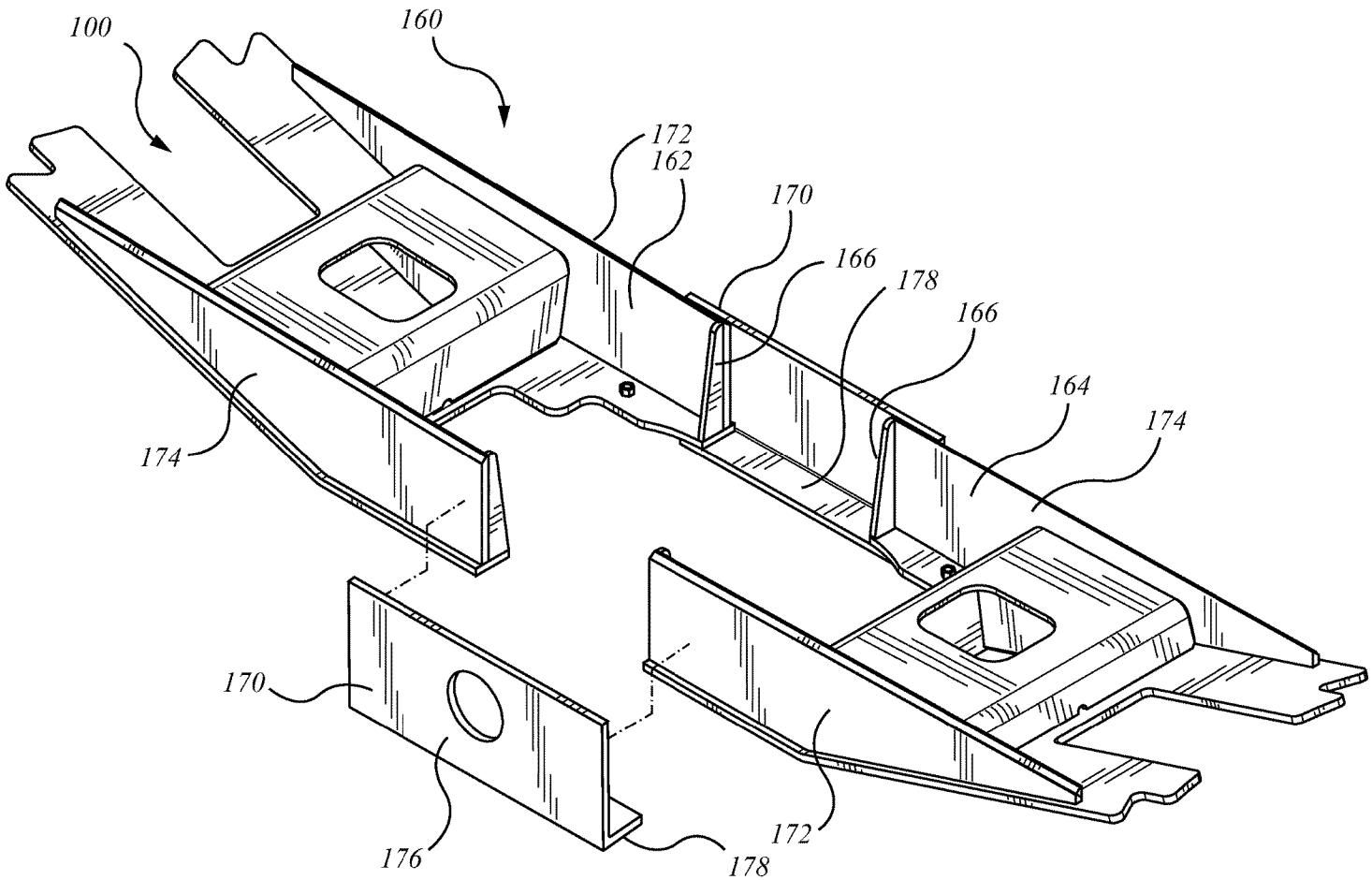
FIG. 5 is an alternate skid plate assembly to that of FIG. 2*a*.
Figure 6:
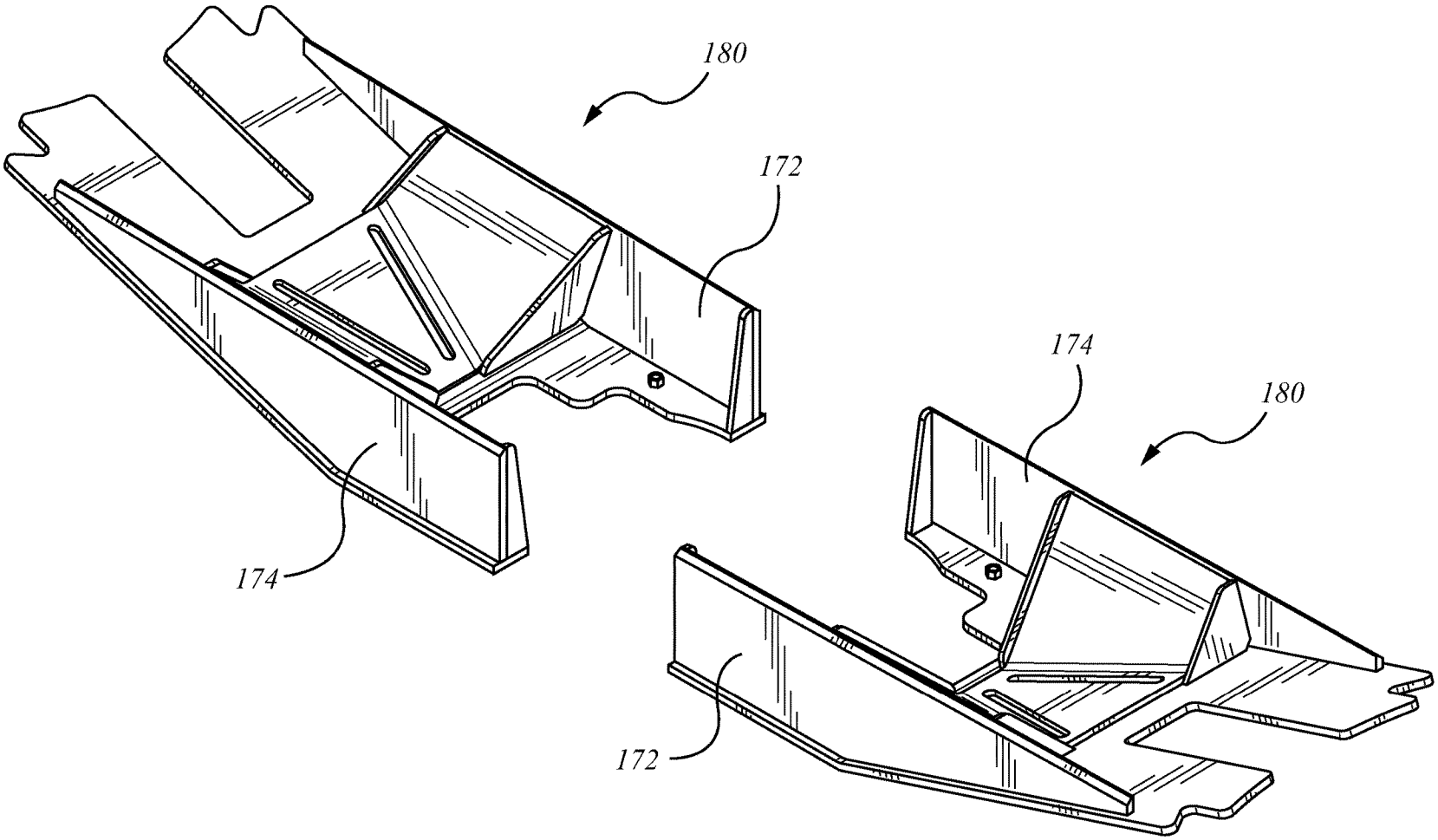
FIG. 6 is an alternate skid plate assembly to that of FIG. 4*a.*

The alternate embodiment of skid plate assembly 160 of FIG. 5 corresponds to skid plate assembly 50 of FIG. 2*a*. The alternate embodiment of skid plate assembly 180 of FIG. 6 corresponds to skid plate assembly 130 of FIG. 4*a*. Skid plate assembly 160 has two halves 162, 164, as if skid plate assembly 50 had been sectioned along the transverse central plane and spread apart, with gussets or stiffeners 166 being located at the corners. The resultant halves may then be mounted to tank car 20, spaced apart at such distance as may be. When so positioned (or before positioning, as may be convenient), in some embodiments an extension member, or closing member, such as plate 170, may be position to fill the gap, and may be lap welded to connect the spaced apart side plate halves 172, 174. The proximate margins may be welded to bars 48. Plate 170 may have a central access aperture 176 such as may admit a pipe or pipes. Plate 170 may also be provided with a flange 178 such as may provide an attachment interface for pipes, valve, or other fittings.

Similarly, skid plate assembly 180 corresponds to skid plate assembly 130 as if skid plate assembly 130 had been sectioned into two halves and separated. Again, plates 170 may be provided to be lap welded to side plate halves 172, 174, in like manner to assembly 160.

The Bottom Outlet Valve (BOV) in a general purpose tank car may tend to be susceptible to leaks during severe derailment events. The embodiments discussed herein relate to designs of reinforced protective skid arrangements that may tend to discourage, or to decrease the chance of, BOV leaks during such events. In all the embodiments described, the skid arrangement is reinforced by formations of plates, webs, gussets, and the like. These assemblies may in some embodiments correspond to, or may comply with the structural requirements of Paragraph 9.1.2.1 of Appendix E of MSRP Section C-III.

The skid assemblies featuring these reinforcements may tend to some extent to be subject to the incident load during derailment. The vertical component of that load may be approximated as being equal to the weight of the car minus the trucks, according to paragraph 9.1.2.1 as applied at any transverse line on the surface of the sloped skid plate. That vertical load may be about 280,000 lbs., applied normal to the skid plate cover. It is desirable that this may occur without structural failure such as may tend to lead to BOV leakage.

The first embodiment, described above and shown in FIGS. 2*a*-2*e*, may include a transverse beam, namely reinforcement 80, with longitudinal (relative to the beam) reinforcement ribs or webs 88 installed inside the skid assembly enclosure, i.e., inside skid shell 52. The webs of the transverse beam may tend to stabilize the skid assembly and may tend to increase the buckling limit of the skid plate cover 52. The skid plate cover 52 may tend to act as the bottom flange of the beam. Both the top flange of the beam, and the transverse web members 82, 86 of the reinforcements may be created by using a formed plate, such as a U-pressing.

The longitudinal ribs 88 may tend to make the skid plate cover more resistant to buckling and may transfer the load to the webs 82, 86 of the transverse beam. The beam may then transfer the load to the webs, i.e., the side plates 56, 58 of the skid arrangement. The side plate webs then transfer the load to longitudinal bars 48 on the bottom of tank car tank 40. Bars 48 may tend to distribute the load over a relatively large area and may thereby tend to decrease the likelihood of tank puncture. Without this beam and the reinforcement it may provide, the skid assembly may be more prone to collapse, and thus fail to protect the BOV, should the impacting object hit a soft, un-supported sloped skid plate cover. In the event of excessive vertical forces, the box structure may deflect, and may on deflection contact the tank car tank and reinforcement bars. If this should occur, it may tend to buckle the transverse (82, 86) and longitudinal (88) ribs of the reinforcing structure and thus form a crumple layer. The crumple layer may tend to absorb the energy of the impact, or may tend to delay or decrease the risk of tank puncture, and, to the extent that this occurs it may tend to improve overall crashworthiness of car 20.

In the second embodiment, namely skid plate assembly 130 of FIGS. 4*a*-4*e*, skid plate cover 52 is reinforced by angled plates, namely reinforcements 136, connected to the top or distal margins of the skid assembly webs, i.e., side plates 56, 58, which in turn are connected to reinforcement bars 48. In this embodiment vertical loads are transferred to the tank reinforcing bars 48 by the truss-like bridge plate i.e., assembly 130. The triangular gussets of reinforcements 134 and 138 may tend to stabilize the bridge plate and may tend to increase the buckling strength of the assembly. Similar to the first embodiment, this design may tend correspondingly to increase the stiffness, strength and crashworthiness of the skid assembly. The second embodiment also provides a non-obstructed longitudinal passage 150 inside and through skid plate assembly 130. As described above, this may be a useful feature where the BOV has heater pipes such as may be connected to an outside steam source, such as may require a longitudinal connection inside the skid assembly.

In the first embodiment, the top flange of the reinforcing beam (namely second member 84) is not connected to the tank car tank surface (unlike some of the previous designs). This may leave room for insulating tank car tank 40 around the BOV. Also, hole 106 provides an access opening on top of the beam, by which to make internal weld passes, and by which later to install additional insulation material inside the assembly. The formation of angled plates 136 in the second embodiment also provides enough space for a measure of insulation application. In both embodiments, the lack of any contact or connection to the tank surface combined with applying insulation may tend somewhat to reduce the heat loss from tank car tank 40 in case of the jacketed cars, and may tend somewhat to decrease heat transfer to tank car tank 40 in a pool fire.

In addition, for both designs, lack of welding or direct connection to the tank surface of the transverse beam (in assembly 50) or of the truss (in assembly 130) may tend to decrease the likelihood of tank puncture by the protective structure. Also, the avoidance (or non-existence) of welds to the tank surface may tend to reduce the risk of fatigue issues on the tank shell. Both embodiments are intended to fit inside the space envelope of existing skid assemblies and in both designs the load path is from the skid assembly webs to the reinforcement bars.

Both designs are implementable as retrofit options for the existing tank cars with similar skid assembly arrangements. First, the existing skid arrangement may be disconnected from reinforcement bars 48 of tank car tank 40. The second step is attaching such of the above described embodiments as may be suitable to reinforcement bars 48. This process is possible since the only attachments are the reinforcement bars of the tanks. That is, the footprint along bars 48 does not require circumferential weldments to plates 38 of tank car tank 40 such as may impair or introduce further uncertainty into the physical integrity or longevity of the structure, and may also tend not to require post weld heat treatment.

Another feature of both designs is increase in the lateral stiffness and strength of the skid assembly, such as may tend to enhance resistance to damage to the BOV in case of a rollover such as may impose lateral forces on the assembly.

Various embodiments have been described in detail. Since changes in and or additions to the above-described examples may be made without departing from the nature, spirit or scope of the invention, the invention is not to be limited to those details.

I claim:

1. A skid assembly for a railroad tank car tank, the tank car tank having a protruding member extending proud thereof, and load spreading apparatus mounted to the tank car tank adjacent the protruding member, the load spreading apparatus extending axially relative to the tank car tank, said skid assembly comprising:

an external skid shell, said skid shell having an accommodation for the protruding member;

said skid shell having a lengthwise extending footprint that mates to the load spreading apparatus;

internal reinforcement within said skid shell, said internal reinforcement being mounted to said skid shell, said internal reinforcement discouraging deformation of said skid shell; and when said footprint is mated to the load spreading apparatus, said internal reinforcement being mounted independently of the tank car tank; and said internal reinforcement defines one of (a) at least a portion of a bridge inside said skid shell, said bridge defining a span that is clear of the tank car tank; and (b) at least a portion of a truss within said skid shell, said truss defining a span that is clear of the tank car tank.

2. The skid assembly of claim 1, the load spreading apparatus of the tank car tank including reinforcement bars that extend axially along the tank car tank, wherein one end of said span is reacted at a first of the reinforcement bars, an opposite end of said span is reacted at a second of the reinforcement bars distant from the first of the reinforcement bars; and said span is clear of the tank car tank between the first and second reinforcement bars.

3. The skid assembly of claim 1 wherein said internal reinforcement includes an axially extending passageway permitting communication with the protruding member from outside the skid shell.

4. The skid assembly of claim 1 wherein said internal reinforcement includes a hollow box.

5. The skid assembly of claim 1 wherein said internal reinforcement has a flange spaced inwardly of said skid shell, and at least a first rib extending between said skid shell and said flange.

6. The skid assembly of claim 1 wherein said internal reinforcement includes the bridge of claim 1, said bridge includes a flange spaced inwardly of said shell, and said bridge includes spaced apart ribs connected inside said bridge between said flange and said skid shell.

7. The skid assembly of claim 6 wherein said bridge has a span direction and said ribs are oriented cross-wise to said span direction.

8. The skid assembly of claim 6 wherein said bridge has a span direction and said ribs include a rib that extends in the span direction and a rib that extends cross-wise to the span direction.

9. The skid assembly of claim 8 wherein said skid assembly includes a first side plate and a second side plate, and said internal reinforcement includes a first beam member and a second beam member extending cross-wise between said first side plate and said second side plate, said beam members being spaced apart in the axial direction.

10. The skid assembly of claim 1 wherein said skid shell includes first and second spaced apart side plates, and a cover plate extending between said first and second side plates; said side plates having respective margins defining first and second portions of said footprint and said internal reinforcement includes a first member having a first portion mounted to said first side plate and a second portion mounted to said cover plate, whereby said internal reinforcement discourages deflection of said cover plate relative to said first side plate.

11. The skid assembly of claim 1 wherein said skid shell includes first and second spaced apart side plates, and a cover plate extending between said first and second side plates; said side plates having respective margins defining first and second portions of said footprint and said internal reinforcement has a flange mounted thereto, said flange being opposed to said cover plate.

12. A skid assembly for a railroad tank car tank, the tank car tank having a protruding member extending proud thereof, and load spreading apparatus mounted to the tank car tank adjacent the protruding member, the load spreading apparatus extending axially relative to the tank car tank, said skid assembly comprising:

an external skid shell, said skid shell having an accommodation for the protruding member;

said skid shell having a lengthwise extending footprint that mates to the load spreading apparatus;

internal reinforcement within said skid shell, said internal reinforcement being mounted to said skid shell, said internal reinforcement discouraging deformation of said skid shell; and when said footprint is mated to the load spreading apparatus, said internal reinforcement being mounted independently of the tank car tank;

said skid shell includes first and second spaced apart side plates, and a cover plate extending between said first and second side plates; said side plates having respective margins defining first and second portions of said footprint;

said internal reinforcement includes a first beam member and a second beam member extending cross-wise between said first side plate and said second side plate, said beam members being spaced apart in the axial direction; and said internal reinforcement includes a flange member spanning said first and second beam members, said flange being spaced inwardly of, and being opposed to, said cover plate.

13. The skid assembly of claim 12 wherein said internal reinforcement has at least a first internal cover reinforcement rib mounted between said cover plate and said flange, said internal rib running transversely to said first and second beams.

14. The skid assembly of claim 12 wherein said internal reinforcement has at least a first internal cover reinforcement rib mounted between said cover plate and said flange, said first internal cover reinforcement rib running transversely to said first and second beams; and a second internal cover reinforcement rib mounted between said cover plate and said flange, said second internal cover reinforcement rib running cross-wise to said first internal cover reinforcement rib.

15. A skid assembly for a railroad tank car tank, the tank car tank having a protruding member extending proud thereof, and load spreading apparatus mounted to the tank car tank adjacent the protruding member, the load spreading apparatus extending axially relative to the tank car tank, said skid assembly comprising:

an external skid shell, said skid shell having an accommodation for the protruding member;

said skid shell having a lengthwise extending footprint that mates to the load spreading apparatus;

said skid shell including a first side plate, a second side plate, and a cover plate;

internal reinforcement within said skid shell, said internal reinforcement being mounted to said skid shell, said internal reinforcement discouraging deformation of said skid shell; and when said footprint is mated to the load spreading apparatus, said internal reinforcement being mounted independently of the tank car tank;

said internal reinforcement includes a first member having a first portion mounted to said first side plate and a second portion mounted to said cover plate, whereby said internal reinforcement discourages deflection of said cover plate relative to said first side plate; and said internal reinforcement includes a second member mounted to a free edge of said first member, said second member having a first edge running along said first side plate, and a second edge mated to and running along said cover plate.

16. The skid assembly of claim 15 wherein said internal reinforcement includes a third member spaced apart from said first member, said second member joining both said first member and said third member.

17. The skid assembly of claim 16 wherein said first member, said second member, said third member, said first side plate and said cover plate form a box.

18. The skid assembly of claim 17 wherein said assembly has opposed first and second internal reinforcements each defining a box, and an axially extending access passageway is defined therebetween.

19. The skid assembly of claim 17 wherein said first member and said third member have the form of triangular gussets forming opposed ends of said box.

20. A skid assembly for a railroad tank car tank, the tank car tank having a member protruding from said tank car tank, the tank car tank having longitudinally extending load spreading apparatus, wherein said assembly comprises:

first and second side members, and a cover member;

said first and second side members each having a longitudinally running margin for mating with the longitudinally extending load spreading apparatus;

said first and second side members defining webs standing away from the tank car tank;

said cover member extending between said side members and functioning as a flange relative to said webs;

at least a first cross-wise oriented reinforcement extending between said first side member and said cover member;

as installed, said cross-wise oriented reinforcement being free of circumferentially running connection to the tank car tank.

21. The skid assembly of claim 20, the load spreading apparatus of the tank car tank including reinforcement bars that extend axially along the tank car tank, wherein one end of said cross-wise reinforcement is reacted at a first of the reinforcement bars, an opposite end of said cross-wise reinforcement is reacted at a second of the reinforcement bars distant from the first of the reinforcement bars; and said cross-wise reinforcement is clear of the tank car tank between the first and second reinforcement bars.

22. The skid assembly of claim 20 wherein said cross-wise reinforcement includes an axially extending passageway permitting communication with the protruding member from outside the shell.

23. The skid assembly of claim 20 wherein said cross-wise reinforcement includes a hollow box.

24. The skid assembly of claim 23 wherein said cross-wise reinforcement includes first and second triangular gussets forming ends of said box.

25. The skid assembly of claim 23 wherein said cross-wise reinforcement includes opposed first and second reinforcements each defining a box, and an axially extending access passageway extends therebetween.

26. The skid assembly of claim 20 wherein said cross-wise reinforcement has a flange spaced inwardly of said skid shell, and at least a first rib extending between said skid shell and said flange.

27. The skid assembly of claim 20 wherein said assembly further includes a second cross-wise oriented reinforcement extending between said second side member and said cover member; each of said first and second cross-wise oriented reinforcements has at least a first internal cover reinforcement rib mounted between said cover plate and said flange, said first internal cover reinforcement rib running transversely to said first and second cross-wise oriented reinforcements respectively; and a second internal cover reinforcement rib mounted between said cover plate and said flange, and said second internal cover reinforcement rib running cross-wise to said first internal cover reinforcement rib.

28. A tank car tank skid assembly for mounting to axially extending reinforcement structure of a tank car tank, said skid assembly comprising:

a skid shell and internal bracing mounted within said skid shell;

said skid shell having a first margin and a second margin, said first and second margins defining axially extending tank car tank mounting interfaces;

said skid shell bridging said tank car tank cross-wise to the axial direction;

said internal bracing including at least a first internal former mounted inside said skid shell, said first internal former including a cross-wise extending web; and said first internal former being free of connection to tank reinforcement.

29. The skid assembly of claim 28 wherein said skid shell and said former co-operate to define a bridge; said bridge includes a flange spaced inwardly of said shell, and said bridge includes spaced apart ribs connected inside said bridge between said flange and said shell.

30. The skid assembly of claim 29 wherein said bridge has a span direction and said ribs are oriented cross-wise to said span direction.

31. The skid assembly of claim 30 wherein said assembly includes ribs oriented in both said span direction and cross-wise to said span direction.

32. A tank car tank skid assembly for mounting to tank car tank, said skid assembly comprising:

a skid shell having axially running feet for connection to load spreading apparatus of the tank car tank, said skid shell having a span between said feet;

internal reinforcement for resisting deformation of said skid shell, said internal reinforcement including at least a first internal reinforcement having a cross-wise web, said web having a first edge and a second edge;

said internal reinforcement including a flange;

said first edge being mounted to said skid shell;

said flange running along said second edge and being opposed to said skid shell;

said internal reinforcement being mounted amidst said span between said feet; and said internal reinforcement being mounted clear of the tank car tank.

33. The skid assembly of claim 32 wherein said internal reinforcement includes spaced apart ribs connected inside said bridge between said flange and said shell, said ribs being oriented axially.

34. The skid assembly of claim 33 including both ribs oriented axially and ribs oriented cross-wise.

* * * * *